US007441539B1

(12) United States Patent
Minami

(10) Patent No.: US 7,441,539 B1
(45) Date of Patent: Oct. 28, 2008

(54) MULTIPOINT IGNITION DEVICE

(75) Inventor: Katsuaki Minami, Nagano (JP)

(73) Assignee: Miyama, Inc., Nagano (JP)

( * ) Notice: Subject to any disclaimer, the term of this patent is extended or adjusted under 35 U.S.C. 154(b) by 0 days.

(21) Appl. No.: 11/976,523

(22) Filed: Oct. 25, 2007

(30) Foreign Application Priority Data

Aug. 6, 2007 (JP) ..... 2007-203842

(51) Int. Cl.
*F02P 15/02* (2006.01)

(52) U.S. Cl. ..... 123/310; 123/638

(58) Field of Classification Search ..... 123/310, 123/638

See application file for complete search history.

(56) References Cited

U.S. PATENT DOCUMENTS 4,535,735 A * 8/1985 Yoshinaga et al. ..... 123/310
6,807,933 B2 * 10/2004 Lipski ..... 123/169 MG
7,299,785 B1 * 11/2007 Lee ..... 123/310
2007/0215101 A1 * 9/2007 Russell et al. ..... 123/310
2007/0215102 A1 * 9/2007 Russell et al. ..... 123/310

FOREIGN PATENT DOCUMENTS

| | | |
|---|---|---|
| JP | 53-034027 | 3/1978 |
| JP | 01-193080 | 8/1989 |
| JP | 02-109286 | 4/1990 |
| JP | 02-123281 | 5/1990 |
| JP | 04-183925 | 6/1992 |
| JP | 04-187870 | 7/1992 |

* cited by examiner

*Primary Examiner*—Erick Solis
(74) *Attorney, Agent, or Firm*—Rabin & Berdo, PC

(57) ABSTRACT

Respective heat values of a plurality of electrode pairs P1 to P8 are set individually such that the temperatures of all of the plurality of electrode pairs (P1 to P8) are kept within an appropriate temperature range in which a temperature no lower than a self-cleaning temperature is set as a lower limit temperature and a lower temperature than a pre-ignition temperature is set as an upper limit temperature.

7 Claims, 3 Drawing Sheets

MULTIPOINT IGNITION DEVICE

TECHNICAL FIELD OF THE INVENTION

This invention relates to a multipoint ignition device in which a plurality of ignition gaps are disposed in a single combustion chamber.

BACKGROUND OF THE INVENTION

JP2-123281A and JP1-193080A disclose a multipoint ignition device in which a plurality of electrode pairs constituting ignition gaps are disposed around a cylinder opening portion such that an air-fuel mixture in a combustion chamber is ignited from the plurality of ignition gaps.

According to this device, in comparison with a conventional spark plug that performs ignition only from the center of the combustion chamber, combustion of the air-fuel mixture in the peripheral edge portions of the combustion chamber is promoted, enabling improvements in engine output and fuel economy.

SUMMARY OF THE INVENTION

When the temperature of the electrode pair is lower than a self-cleaning temperature (between 450° C. and 500° C.), carbon sticks to the electrode pair, and as a result, a secondary voltage leaks, causing pollution such that a spark can no longer fly from the electrode pair. Conversely, when the temperature of the electrode pair rises above 1000° C., the electrode pair itself becomes a heat source, and this leads to pre-ignition, whereby ignition occurs before the spark flies. Hence, the temperature of each electrode pair in this multipoint ignition device must be maintained within an appropriate range (between 450° C. and 1000° C., and more preferably between 500° C. and 850° C. so as to leave a margin for error).

However, in the prior art described above, all of the electrode pairs are set with an identical heat value, regardless of the fact that the amount of heat received by the electrode pairs from the wall surface of the combustion chamber and the combustion gas and the amount of heat lost to fresh air differ according to the position of the electrode pair. Hence, the temperature of certain electrode pairs falls below an appropriate temperature range, causing pollution, while the temperature of other electrode pairs rises above the appropriate temperature range, causing pre-ignition.

This invention has been designed in consideration of the problems in the prior art, and it is an object thereof to prevent both electrode pair pollution and pre-ignition in a multipoint ignition device.

In a multipoint ignition device according to this invention, respective heat values of a plurality of electrode pairs are set individually such that temperatures of all of the plurality of electrode pairs are kept within an appropriate temperature range in which a temperature no lower than a self-cleaning temperature is set as a lower limit temperature and a lower temperature than a pre-ignition temperature is set as an upper limit temperature.

According to this invention, the temperatures of all of the electrode pairs can be kept within the appropriate temperature range, and as a result, pollution of the electrode pairs and the occurrence of pre-ignition can be prevented.

DESCRIPTION OF THE PREFERRED EMBODIMENT

An embodiment of this invention will be described below with reference to the attached drawings. In the following description, the heat radiation property of an electrode pair is expressed as a "heat value", similarly to a conventional spark plug. Accordingly, a good heat radiation property is referred to as a "high heat value", and a poor heat radiation property is referred to as a "low heat value".

Figure 1:
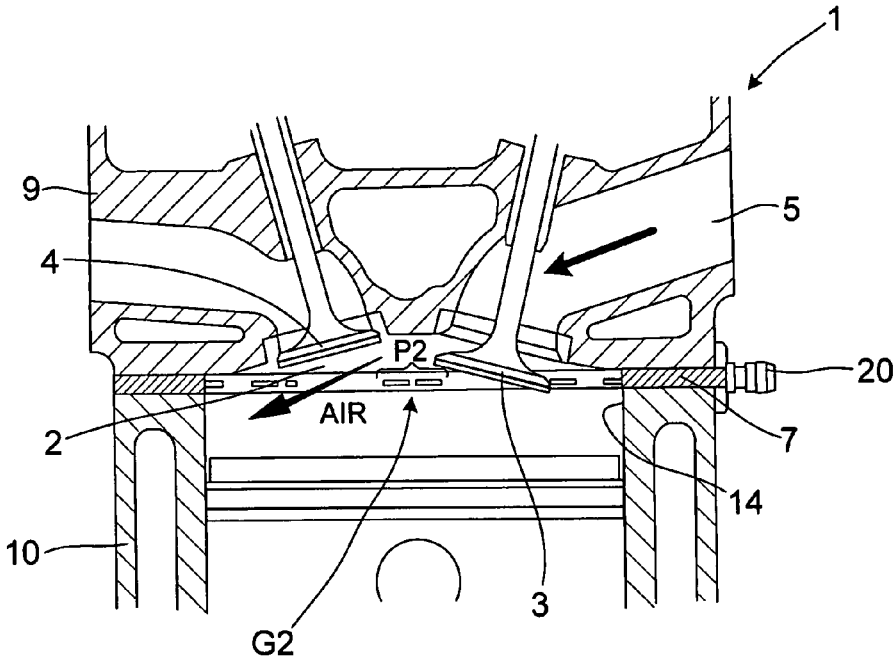
FIG. 1 is a schematic constitutional diagram of an engine comprising a multipoint ignition device according to this invention.

FIG. 1 shows the schematic constitution of an engine 1 comprising a multipoint ignition device 7 according to this invention. The engine 1 is a four-valve engine having two intake valves 3 and two exhaust valves 4 for a single combustion chamber 2. In this example, the intake valve 3 is mounted in a near-horizontal state (the valve stem is near-vertical), and the majority of fresh air that is introduced into the combustion chamber 2 through an intake port 5 via the intake valve 3 flows to the exhaust side along an upper surface of the combustion chamber 2.

Figure 2:
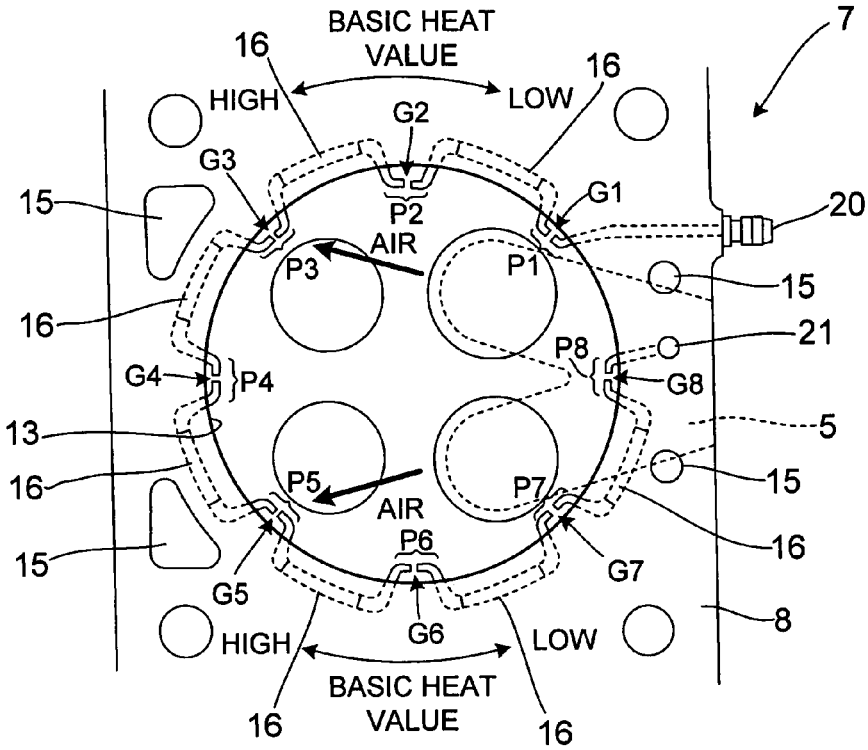
FIG. 2 is a schematic constitutional diagram of the multipoint ignition device.

As shown in FIG. 2, the multipoint ignition device 7 is formed integrally with a head gasket 8 of the engine 1. When the multipoint ignition device 7 is sandwiched between a cylinder head 9 and a cylinder block 10 of the engine 1, a plurality of electrode pairs P1 to P8 constituting ignition gaps G1 to G8 are disposed at substantially equal intervals around a cylinder opening portion 14 that opens onto an upper surface of the cylinder block 10. Each electrode pair P1 to P8 is constituted by a current-carrying electrode and an earth electrode that faces the current-carrying electrode via a minute gap. Similarly to a pre-existing electrode of a spark plug of the engine, each electrode pair P1 to P8 is formed from a metal exhibiting high heat resistance, such as nickel or platinum.

A plurality of openings are formed in the head gasket 8, and a central opening 13, which is the largest opening, has a substantially identical diameter to the cylinder opening portion 14 and is superposed on the cylinder opening portion 14. A plurality of openings 15 disposed around the central opening 13 serve as water holes connected to cooling water passages formed in the cylinder head 9 and cylinder block 10.

An intermediate member 16 formed from a conductive material is connected to each of the electrode pairs P1 to P8 such that adjacent electrode pairs are connected by the intermediate member 16. The intermediate members 16 are formed from the same material as the electrode pairs P1 to P8, for example nickel, but may be formed from a different material, as will be described below. The intermediate members 16 are buried in and held by the head gasket 8, and thus the electrode pairs P1 to P8 are held on the head gasket 8.

As well as functioning to hold the electrode pairs P1 to P8, the intermediate members 16 function to connect the electrode pairs P1 to P8 electrically in series. Hence, when a high secondary voltage is applied to a terminal 20, discharge occurs first in the gap G1 of the electrode pair P1 connected to the terminal 20, after which discharge occurs in the gap G2 of the electrode pair P2 adjacent thereto. Discharge then occurs in the manner of a chain reaction in sequence from the terminal 20 side until finally, discharge occurs in the gap G8 of the electrode pair P8 connected to an earth terminal 21.

In this multipoint ignition device 7, similarly to a conventional spark plug, pollution occurs when the temperature of the electrode pairs P1 to P8 is lower than a self-cleaning temperature. Conversely, when the temperature rises excessively, pre-ignition occurs. Hence, the respective heat values of the electrode pairs P1 to P8 must be adjusted to appropriate values so that the temperature of all of the electrode pairs P1 to P8 is kept within an appropriate temperature range, or preferably so that the temperature of all of the electrode pairs P1 to P8 is substantially equal to a predetermined temperature within the appropriate temperature range. A lower limit temperature of the appropriate temperature range is no lower than the self-cleaning temperature (for example, 450° C., or 500° C. to allow a margin for error), and an upper limit temperature is less than a temperature at which pre-ignition occurs (for example, 1000° C., or 850° C. to allow a margin for error).

Hence, in the multipoint ignition device 7 according to this invention, the respective heat values of the electrode pairs P1 to P8 are set individually according to the position of the electrode pair in the following manner.

Figure 3:
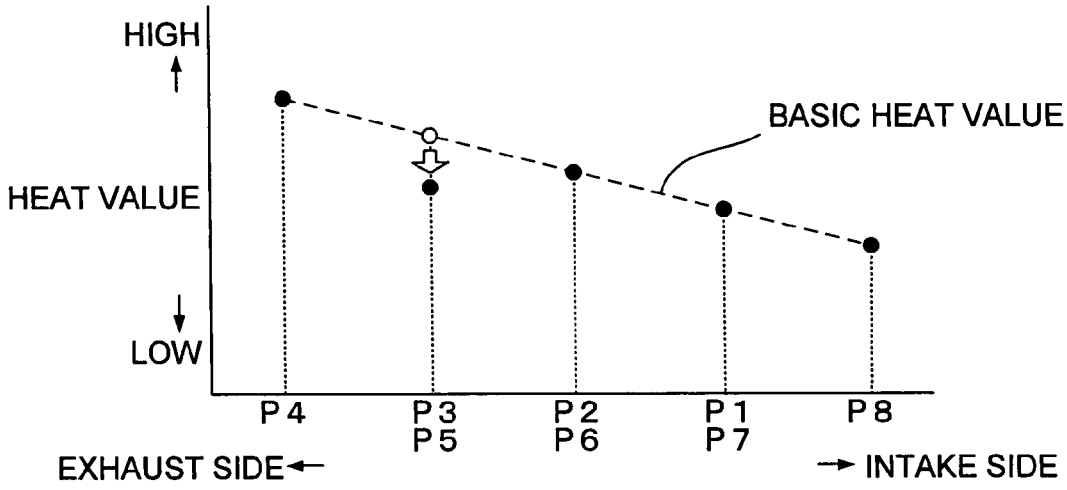
FIG. 3 is a view showing a heat value of each electrode pair.

First, as shown by a broken line in FIG. 3, a basic heat value is set to become gradually higher toward the electrode pairs disposed on the exhaust side (exhaust port side) of the cylinder opening portion 14. The basic heat value is a parameter used when setting the heat value of the electrode pairs P1 to P8, which is set for each electrode pair in accordance with the temperature of the combustion chamber wall on which the electrode pairs P1 to P8 are disposed. The reason for setting the basic heat value higher on the exhaust side than on the intake side is that the temperature on the exhaust side of the combustion chamber wall is higher than the temperature on the intake side by 50° C. or more due to heat transfer from the high-temperature exhaust valve 4 and the valve seat portion thereof, and this temperature difference leads to deterioration of the heat radiation property of the electrode pairs disposed near the exhaust side of the combustion chamber wall. It should be noted, however, that this depends on the operating conditions of the engine 1.

Next, the heat values of the electrode pairs, from among the electrode pairs P1 to P8, on which fresh air introduced into the combustion chamber 2 through the intake port 5 impinges directly, i.e. the electrode pairs P3 and P5 disposed on the line of extension of the intake port 5 in this embodiment, are set at lower values than the basic heat values thereof. The term "on which fresh air impinges directly" means that the fresh air introduced into the combustion chamber 2 impinges on the electrode pair before colliding with the combustion chamber wall and piston crown. The reason for setting the heat value of the electrode pairs P3, P5 on which the fresh air impinges directly to be lower than the basic heat value is that these electrode pairs P3, P5 lose heat to the fresh air such that the temperature thereof falls. By setting the heat value lower than the basic heat value, the temperature of the electrode pairs P3, P5 can be maintained at or above the self-cleaning temperature. On the other hand, the respective heat values of the electrode pairs P1, P2, P4, P6 to P8 on which the fresh air does not impinge directly are set at the basic heat values set as described above.

By setting the respective heat values of the electrode pairs P1 to P8 individually in accordance with the positions thereof in this manner, the temperature of all of the electrode pairs P1 to P8 can be held within the appropriate temperature range, or more preferably at a predetermined temperature within the appropriate temperature range, and as a result, pollution of the electrode pairs P1 to P8 and the occurrence of pre-ignition can be prevented.

Here, the heat values of the electrode pairs P1 to P8 are set in consideration of only the position of the electrode pair and whether or not fresh air directly impinges thereon. However, other factors contributing to the heat radiation property of the electrode pairs P1 to P8, for example the amount of heat received from the combustion gas, the distance from the cooling water passages, and so on may also be taken into account.

Further, the engine 1 of this embodiment is constituted such that a gas flow is not generated in the combustion chamber 2. However, in an engine that generates a gas flow (a swirl flow or a tumble flow) in the combustion chamber, the basic heat value of the electrode pair positioned on the farthest upstream side of the gas flow should be reduced by a maximum amount, and the basic heat values of the other electrode pairs should be reduced by steadily smaller amounts in the direction of the gas flow.

Next, a specific method of adjusting the heat value of the electrode pairs P1 to P8 will be described.

Figure 4:
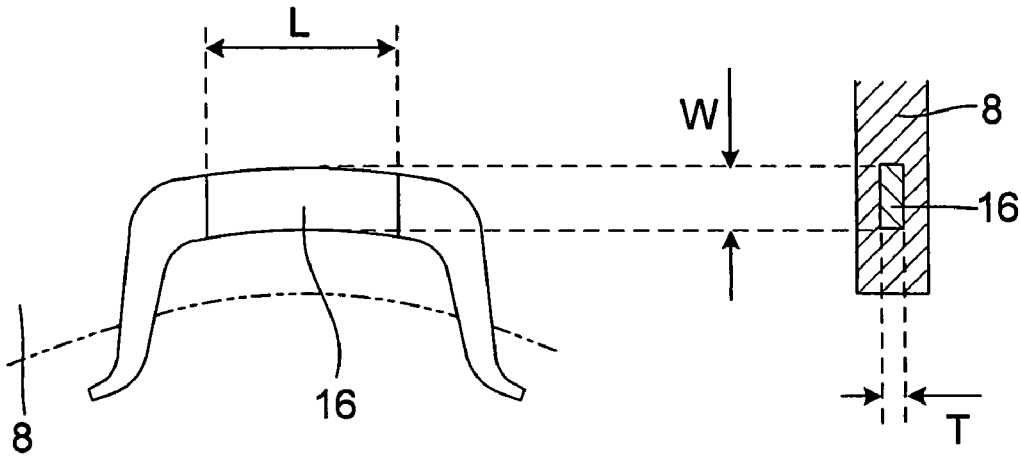
FIGS. 4 and 5 are views illustrating a method of adjusting the heat value of the electrode pair.

In a first method, a contact area between the head gasket 8 and the intermediate member 16 is modified. When adjusting the heat value of a certain electrode pair (to be referred to hereafter as Px) from among the electrode pairs P1 to P8, at least one of a length L, a width W, and a thickness T (see FIG. 4) of the intermediate member 16 that is connected to the electrode pair Px should be modified to modify the contact area between the intermediate member 16 connected to the electrode pair Px and the head gasket 8.

For example, when at least one of the length L, width W, and thickness T of the intermediate member 16 connected to the electrode pair Px is increased, the amount of heat transferred from the electrode pair Px to the cylinder head 9 and cylinder block 10 through the intermediate member 16 and the head gasket 8 increases, and thus the heat value of the electrode pair Px can be increased. Conversely, to lower the heat value of the electrode pair Px, at least one of the length L, width W, and thickness T of the intermediate member 16 connected to the electrode pair Px may be reduced.

Alternatively, by forming an irregularity such as a groove or a projection on the surface of the intermediate member 16 connected to the electrode pair Px or bending the surface of the intermediate member 16, the contact area between the intermediate member 16 connected to the electrode pair Px and the head gasket 8 can be increased (not shown). Likewise with this constitution, the heat radiation property of the electrode pair Px improves, and as a result, the heat value can be increased.

Figure 5:
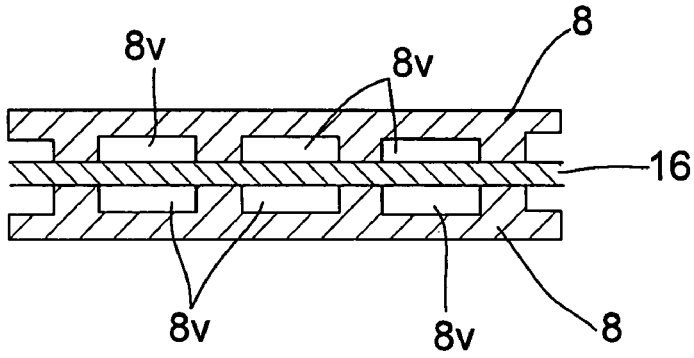

Alternatively, as shown in FIG. 5, one or more voids 8*v* may be formed between the head gasket 8 and the intermediate member 16 to reduce the contact area between the intermediate member 16 connected to the electrode pair Px and the head gasket 8. According to this constitution, heat is less likely to be transferred from the electrode pair to the cylinder head 9 and cylinder block 10 through the intermediate member 16 and the head gasket 8, and as a result, the heat value of the electrode pair Px can be reduced.

To ensure the strength of the multipoint ignition device 7, a thermal insulation material may be filled into the voids 8*v*. Moreover, voids may be formed between the head gasket 8 and the intermediate member 16 by providing irregularities on the intermediate member 16 side rather than the head gasket 8 side.

In a second method, the intermediate member 16 connected to the electrode pair Px is formed from a different material to the electrode pair Px. When the intermediate member 16 is formed from a material exhibiting higher thermal conductivity than the material of the electrode pair Px, for example copper, the amount of heat transferred from the electrode pair Px to the cylinder head 9 and cylinder block 10 through the intermediate member 16 and the head gasket 8 increases, and thus the heat value of the electrode pair Px can be increased. Conversely, to lower the heat value of the electrode pair Px, the intermediate member 16 connected to the electrode pair Px may be formed from a material exhibiting lower thermal conductivity than the material of the electrode pair Px, for example carbon or glass fiber coated in carbon.

It should be noted that the first and second methods described above are merely examples of heat value adjustment methods, and other methods may be used. Further, a plurality of heat value adjustment methods, including the first and second methods described above, may be implemented in combination.

An embodiment of this invention was described above, but this embodiment is merely an example of application of the invention, and the technical scope of the invention is not limited to the specific constitution described above.

What is claimed is:

1. A multipoint ignition device having a plurality of electrode pairs constituting ignition gaps, the plurality of electrode pairs being disposed around a cylinder opening portion of an engine, wherein respective heat values of the plurality of electrode pairs are set individually such that temperatures of all of the plurality of electrode pairs are kept within an appropriate temperature range in which a temperature no lower than a self-cleaning temperature is set as a lower limit temperature and a lower temperature than a pre-ignition temperature is set as an upper limit temperature, and wherein the heat value of an electrode pair disposed on an exhaust side of the cylinder opening portion is raised to keep the temperature of the electrode pair within the appropriate temperature range.

2. A multipoint ignition device having a plurality of electrode pairs constituting ignition gaps, the plurality of electrode pairs being disposed around a cylinder opening portion of an engine, wherein respective heat values of the plurality of electrode pairs are set individually such that temperatures of all of the plurality of electrode pairs are kept within an appropriate temperature range in which a temperature no lower than a self-cleaning temperature is set as a lower limit temperature and a lower temperature than a pre-ignition temperature is set as an upper limit temperature, and wherein the heat value of an electrode pair on which fresh air introduced into a combustion chamber of the engine impinges directly is lowered to keep the temperature of the electrode pair within the appropriate temperature range.

3. A multipoint ignition device having a plurality of electrode pairs constituting ignition gaps, the plurality of electrode pairs being disposed around a cylinder opening portion of an engine, wherein respective heat values of the plurality of electrode pairs are set individually such that temperatures of all of the plurality of electrode pairs are kept within an appropriate temperature range in which a temperature no lower than a self-cleaning temperature is set as a lower limit temperature and a lower temperature than a pre-ignition temperature is set as an upper limit temperature, the multipoint ignition device further comprising:

an intermediate member that electrically connects adjacent electrode pairs; and an interposed member interposed between a cylinder head and a cylinder block of the engine, in which the intermediate member is buried, wherein the heat value of an electrode pair connected to the intermediate member is modified by modifying a contact area between the intermediate member and the interposed member.

4. The multipoint ignition device as defined in claim 3, wherein the contact area between the intermediate member and the interposed member is modified by modifying at least one of a length, a width, and a thickness of the intermediate member.

5. The multipoint ignition device as defined in claim 3, wherein the contact area between the intermediate member and the interposed member is modified by providing one or more voids between the intermediate member and the interposed member.

6. The multipoint ignition device as defined in claim 3, wherein the heat value of the electrode pair connected to the intermediate member is modified by making a material of the intermediate member different to a material of the electrode pair.

7. A multipoint ignition device having a plurality of electrode pairs constituting ignition gaps, the plurality of electrode pairs being disposed around a cylinder opening portion of an engine, wherein respective heat values of the plurality of electrode pairs are set individually such that temperatures of all of the plurality of electrode pairs are kept within an appropriate temperature range in which a temperature no lower than a self-cleaning temperature is set as a lower limit temperature and a lower temperature than a pre-ignition temperature is set as an upper limit temperature, the multipoint ignition device further comprising:

an intermediate member that electrically connects adjacent electrode pairs; and an interposed member interposed between a cylinder head and a cylinder block of the engine, in which the intermediate member is buried, wherein the heat value of an electrode pair connected to the intermediate member is modified by making a material of the intermediate member different to a material of the electrode pair.

* * * * *